United States Patent [19]

Williams

[11] Patent Number: 5,056,673

[45] Date of Patent: Oct. 15, 1991

[54] GIN FOR ELECTRICAL EQUIPMENT

[75] Inventor: Danny R. Williams, Houston, Tex.

[73] Assignee: Houston Industries Incorporated, Houston, Tex.

[21] Appl. No.: 519,117

[22] Filed: May 4, 1990

[51] Int. Cl.[5] ..... B66C 23/18

[52] U.S. Cl. ..... 212/179; 212/266; 212/268; 212/182; 212/267; 254/134.3 PA

[58] Field of Search ..... 212/175, 179, 182, 199, 212/202, 230, 244, 264, 265-267, 268; 254/389, 390, 399, 402, 409, 134, 134.3 PA

[56] References Cited

U.S. PATENT DOCUMENTS

| | | | |
|---|---|---|---|
| Re. 30,611 | 5/1981 | Wappler | 212/254 |
| 272,236 | 2/1883 | Glennon | 212/179 |
| 348,726 | 9/1886 | Driver | 212/179 |
| 971,686 | 10/1910 | Michael | 212/179 |
| 1,154,460 | 9/1915 | Walston | 212/175 |
| 1,256,688 | 2/1918 | Hall | 212/179 |
| 1,319,964 | 10/1919 | Morgan | 212/179 |
| 1,551,225 | 8/1928 | Tsigris | 212/179 |
| 1,879,848 | 9/1932 | Horne | 248/214 |
| 1,955,259 | 4/1934 | Streeter | 248/214 |
| 2,153,803 | 4/1939 | Jarabek | 212/179 |
| 2,178,470 | 10/1939 | Coats | 212/179 |
| 2,610,744 | 9/1952 | Dague | 212/202 |
| 2,833,423 | 5/1958 | Tucker | 212/179 |
| 3,064,824 | 11/1962 | Beatty | 212/179 |
| 3,084,808 | 4/1963 | Peduzzi et al. | 212/254 |
| 3,978,989 | 9/1976 | Avila, Jr. | 212/179 |
| 4,684,031 | 8/1987 | Bergman et al. | 212/179 |

FOREIGN PATENT DOCUMENTS

| | | | |
|---|---|---|---|
| 565371 | 3/1958 | Belgium | 254/399 |
| 2306156 | 10/1976 | France | 212/179 |

*Primary Examiner*—Joseph F. Peters, Jr.
*Assistant Examiner*—R. B. Johnson
*Attorney, Agent, or Firm*—Pravel, Gambrell, Hewitt, Kimball, & Krieger

[57] ABSTRACT

A gin or lifting mechanism is provided for relatively heavy electrical equipment, such as transformers and the like. The gin is removably mounted on a pole above a cluster rack which is to receive the electrical equipment. The gin transfers the load of the equipment to the pole along a vertical central axis of the pole at an intermediate position between its upper and lower ends. The gin has an adjustable length support arm which is particularly suitable for movement of relatively heavy loads, especially in areas inaccessible to load lifting vehicles.

12 Claims, 3 Drawing Sheets

GIN FOR ELECTRICAL EQUIPMENT

BACKGROUND OF INVENTION

1. Field of Invention

The present invention relates to gins, or lifting mechanisms, for relatively heavy electrical equipment.

2. Description of Prior Art

A number of gins or lifting mechanisms for transformers are to be found in the prior art. These gins were primarily intended for use in areas which were inaccessible to a service truck. Certain of these gins, such as those described in U.S. Pat. Nos. 971,686; 1,879,848; 2,153,803; 2,833,423; 3,064,824; and 4,684,031, located the central vertical load bearing axis of the gin at a spaced position from the central vertical axis of the pole. This was undesirable because the load bearing capacity of the pole was not efficiently used.

Other gins, such as those disclosed in U.S. Pat. Nos. 971,686; 1,256,688; 1,319,964; 1,879,848; 1,955,259; and 2,833,423, required installation to the pole at its top. This required one of the field crew to climb to the top of the pole one or more times with portions of the gin to install it. This was undesirable since safety regulations generally prevented climbing to the power line height, much less above it.

Still another type of gins, of the type set forth in U.S. Pat. Nos. 2,153,803; 2,833,423; 3,064,824; and 4,684,031 had load bearing booms which were pivotally movable in a horizontal plane. This was also undesirable for safety reasons when working in the presence of live electrical power, since the boom could be pivoted into contact with a power line.

SUMMARY OF INVENTION

Briefly, the present invention comprises a new and improved lifting mechanism for lifting equipment such as transformers and the like to be mounted on a utility pole. The lifting mechanism includes a lifting arm for lifting the equipment which is attached to the pole at an intermediate portion between its upper and lower ends. The mechanism is provided with load transfer structure between the lifting arm and the pole which transfers the load representing the weight of the equipment to the pole along a vertical central axis of the pole. The lifting mechanism of the present invention is also provided with structure by means of which a line crew member may move the equipment inwardly and outwardly in a horizontal plane with respect to the vertical central axis of the pole.

DESCRIPTION OF PREFERRED EMBODIMENT

Figure 1:
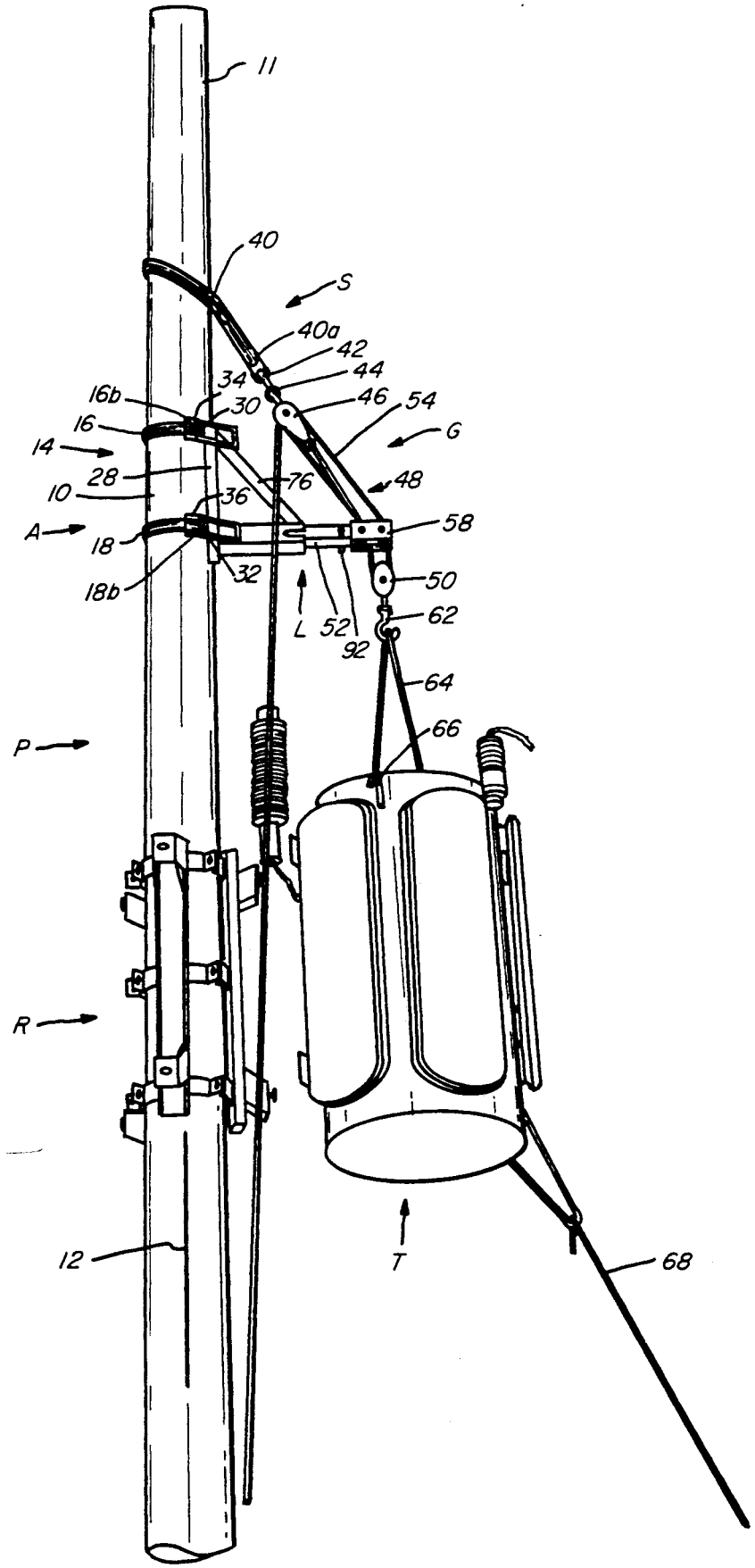
FIG. 1 is an isometric view of a lifting mechanism according to the present invention lifting electrical equipment for mounting on a utility pole.

In the drawings, the letter G designates generally a gin or lifting mechanism for lifting a transformer T or other comparatively heavy electrical equipment to be mounted on a pole P by means of a cluster rack R or other suitable mounting structure. The gin G includes a lifting arm L for lifting the transformer T and an attaching arrangement A. As will be set forth, the attaching arrangement A attaches the lifting arm L to the pole P at an intermediate portion 10 above the cluster rack R, but below an upper portion 11 of the pole P above which the power lines are located. The gin G also includes load transfer structure S which transfers the load or weight of the transformer T to the pole p along a vertical central axis 12 thereof.

The attaching arrangement A takes the form of an attaching yoke 14 which includes upper and lower attaching belts 16 and 18 formed of a suitable strength material, such as synthetic resin, fiber-reinforced synthetic resin or metal bands. If desired, chains might also be used.

Figure 3:
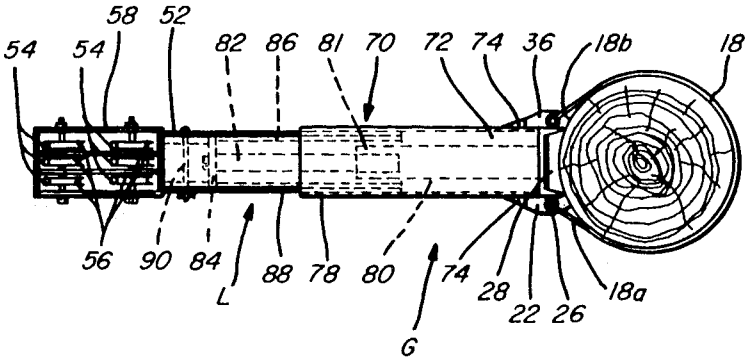
FIG. 3 is a cross-sectional view taken along the lines 3—3 of FIG. 2.

The belts 16 and 18 are each attached at one end 16*a* and 18*a*, respectively, by yoke members 20 and 22 to mounting pins 24 and 26 on a yoke arm 28 generally in the form of a channel member (FIG. 3) which extends vertically along the length of the pole P. The attaching belts 16 and 18 are adapted to be wrapped about the pole P at a desired height above the cluster rack R.

End portions 16*b* and 18*b* of belts 16 and 18 are then passed through releasable locking clasps or buckles 30 and 32 mounted within channel members 34 and 36 on yoke arm 28. The attaching belts 16 and 18 of the attaching arrangement A are thus attached to lifting arm L by being wrapped and tightened about the pole P at which time the locking clasps 30 and 32 grip the belts 16 and 18 firmly. The lifting arm L and the attaching yoke 14 are thus firmly held in place on the pole P.

The load transfer structure S includes a pulley support strap 40 which extends about the pole P above the attaching yoke 14. The support strap 40 is formed of a material of suitable strength, such as those enumerated above for the attaching belts 16 and 18. The support strap 40 is somewhat longer than the circumference of the pole P, permitting movement of the support strap 40 to a desired angle with respect to the horizontal angle of lifting arm L for load transfer purposes to the pole P.

The support strap 40 has a connector hook 42 mounted at a lower end 40*a* for attachment with an attaching eyelet 44 of a first or upper pulley 46 of a block and tackle assembly 48. The block and tackle assembly 48 also includes a second or lower pulley 50 located beneath an outer end 52 of the lifting arm L. A suitable number of loops of a rope or cable 54 extend between the upper pulley 46 and lower pulley 50 to provide the requisite mechanical lifting advantage.

The rope or cable 54 passes over a suitable number of sheaves or sheave wheels 56 rotably mounted in a sheave box 58 on the outer end 52 of the lifting arm L. A pulley portion 60 representing one end of the rope 54 extends downwardly over the upper pulley 46 to a conventional hoist mechanism, which can be either electrically or mechanically driven.

A suspension hook 62 mounted beneath the lower pulley 50 is adapted to receive a suspension rope or cable 64 attached to conventional lifting lug 66 formed on upper portions of the transformer T. A guide rope 68 is typically attached to a lower portion of transformer T so that a ground member of the installing crew may assist the crew member on the pole P during installation of the transformer T.

The lifting arm L includes a housing member 70 fixedly mounted at an inner end 72 by connector plates 74 to the yoke arm 28. A support strut 76 extends between an outer end 78 of the housing member 70 and an upper portion 28*a* of the yoke arm 28 for support purposes. However, support afforded by the strut 76 is primarily for structural integrity of the lifting arm L and attaching mechanism A, since the load transfer structure S according to the present invention bears substantially the entire weight of the transformer T being lifted and installed.

A fluid cylinder member 80 is mounted within the housing member 70 and is thus mounted with the pole P. Cylinder member 80 receives a piston member 81 which is attached by a shaft 82 to a mounting block 84 which is mounted with the sheave box 58 at the outer end 52 of the lifting arm L. A sleeve member 86 mounted with the sheave box 58 and receiving the piston member 81 and shaft 82 is mounted within an outer sleeve 88 by connector pin 90. The sleeve members 86 and 88 are slideably moveable within the housing 70 of the lifting arm L as fluid enters or leaves the cylinder 80 and piston 81 through a port 92 (FIG. 1). Entry of fluid into and out of the port 92 may be controlled by suitable pump control mechanisms either by an installation crew member on the pole P or one on the ground.

With the present invention, it has been found that several advantages over the prior art are afforded. First, the attaching mechanism A need not be located at the top of pole P, but rather at an intermediate portion, affording significant operation and safety advantages. Additionally, the load transfer structure S permits the weight of the load of the transformer T to be transferred to the vertical central axis 12 of the pole P. This permits, from a structural standpoint, substantially full use of the load bearing capabilities of the pole P without having to attach support equipment atop the pole P. Further the lifting arm L confines movement of the transformer T once it is at a proper height for attachment to the cluster rack R to movement inwardly and outwardly in a horizontal plane with respect to the central axis 12 of the pole P. In this matter, hazardous pivotal arm movement is precluded.

Figure 2:
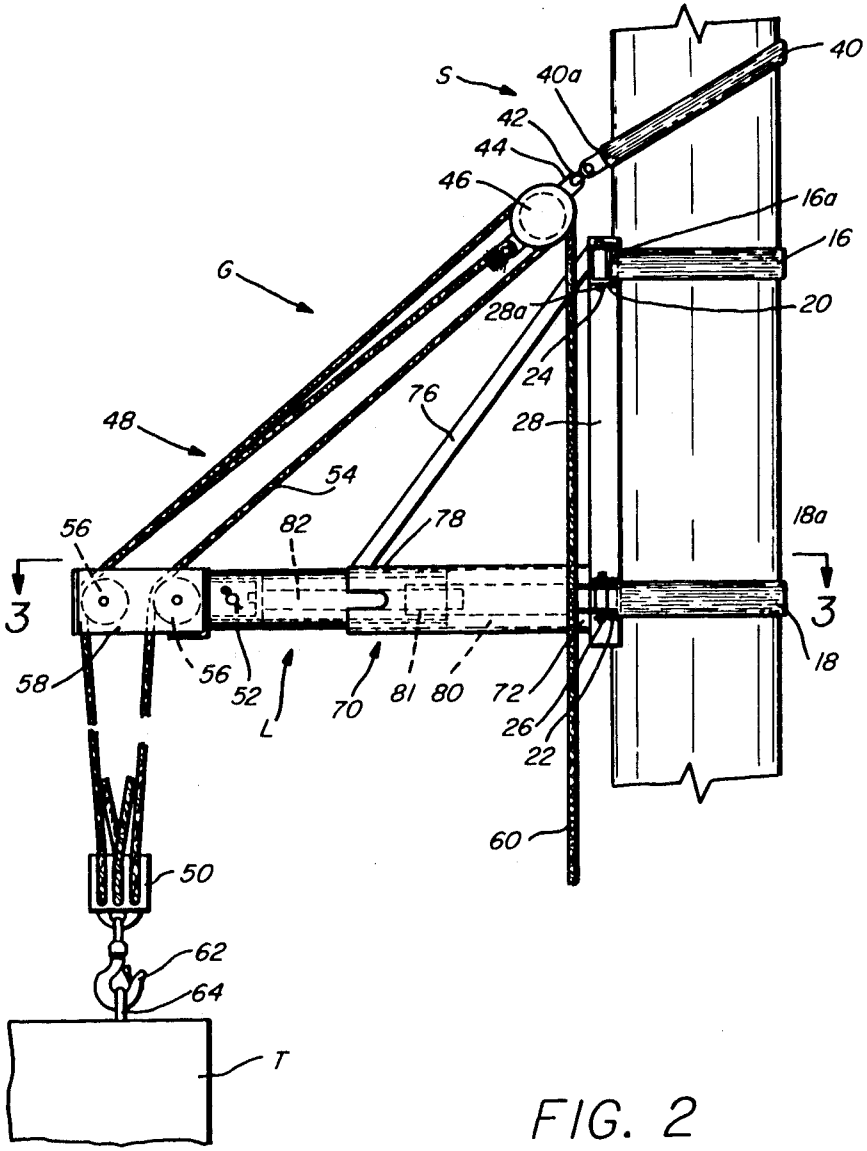
FIG. 2 is an elevation view of the lifting mechanism of FIG. 1.
Figure 5:
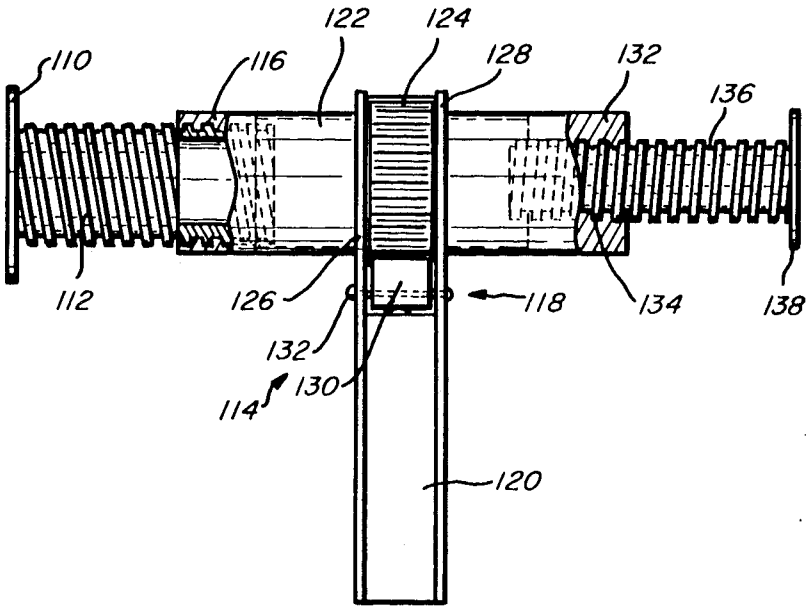
FIG. 5 is an elevation view, taken partly in cross-section, of a portion of the mechanism of FIG. 4.
Figure 4:
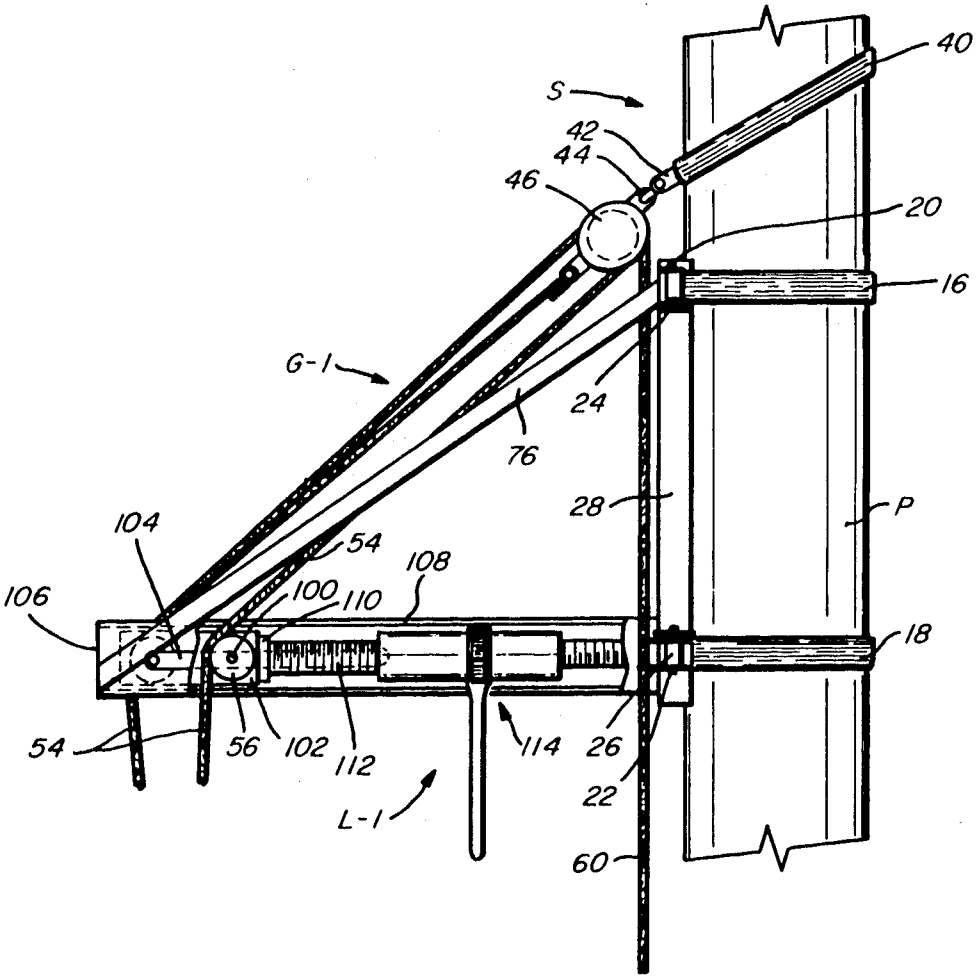
FIG. 4 is an elevation view, taken partly in cross-section, of an alternate lifting mechanism according to the present invention.

In an alternative of gin G-1 of the present invention (FIGS. 4 and 5), like structure to that of the present invention bears like reference numerals. Rather than having a fluid powered movement mechanism in the lifting arm L as in FIGS. 1–3, a mechanically powered lifting arm L-1 is provided.

In the lift mechanism L-1, axles 100 of sheaves 56 extend outwardly through a sheave wheel box 102 into an elongate horizontal slot 104 formed at an outer end 106 of an arm 108 of the lifting arm L-1. The sheave wheel box 102 is slidably moveable within the arm 108, a length defined by the length of the slot 104.

A connector plate 1!,0 connects the sheave wheel box to a threaded gear 112 of a moving mechanism 114. The moving mechanism 114 includes a threaded inner sleeve portion 116 having threads which mate with the threaded rod 112; and permit relative movement of the thread 112 and thus the sheave wheel box 102 under control of a reversible ratchet mechanism 118.

Ratchet mechanism 118 includes a ratchet arm 120 fixedly mounted to a sleeve member 122 in which the threaded socket 116 is formed. A set of cylindrically arranged ratchet teeth 124 extend outwardly from the sleeve 122 between connector yokes 126 and 128 formed at an inner end of the ratchet arm 120.

A reversible ratchet lug 130 is pivotally mounted by a pin 132 in a socket formed in the ratchet arm 120. The setting of the ratchet arm 130 controls whether the sleeve 122 is rotated clockwise or counter-clockwise with respect to the threaded shaft 112.

An inner portion 132 of the sleeve 122 has an inner threaded cylindrical surface 134 formed therein whose gears are adapted to mate with the gears formed on a threaded shaft 136. The threading of gears 134 and 136 is the reverse of that of the gears 112 and 116.

A connector plate 138 at an inner end of the threaded rod 136 is fixedly mounted to the yoke arm 28, connecting the lift mechanism L-1 to the pole P by means of the attaching mechanism A. Depending on the setting of the ratchet lug 130, rotation of the ratchet arm 120 causes both the threaded rods 112 and 136 to be drawn into their respective threaded sockets 116 and 134 or, conversely, advanced outwardly therefrom.

In the operation of the gin mechanism G-1, operations proceed in a like manner to the gin mechanism G until it is desired to move the transformer T inwardly or outwardly with respect to the pole P. The ratchet arm 130 is set in the desired position to advance or recede the threaded rods 112 and 136 in their respective threaded sockets, causing relative movement between the sheave wheel box 102 within the arm 108, causing the load beneath the lifting mechanism L-1 to move in the desired horizontal plane with respect to the vertical axis 12 of the pole P.

Having described the invention above, various modifications of the techniques, procedures, material and equipment will be apparent to those in the art. It is intended that all such variations within the scope and spirit of the appended claims be embraced thereby.

I claim:

1. A lifting mechanism adapted to be removably connected to a vertically extending support for lifting a load relative thereto, comprising:

a generally horizontally extending lifting arm with an inner end and an outer end;

sheave wheel means mounted on the said lifting arm at said outer end;

means for removably attaching said inner end of said lifting arm to a selected intermediate portion of the vertically extending support;

load transfer means removably mounted to the vertically extending support at a location above said lifting arm and at an angle thereto;

said load transfer means being operative to transfer a component of the force of the load that is lifted by said lifting arm to the vertically extending lifting support;

lift assembly means including an upper pulley, means connecting said upper pulley to said load transfer means at a location above said lifting arm, a lower pulley located beneath said outer end of said lifting arm, and means attached to said lower pulley for engaging a load to be lifted by the mechanism;

load hoist rope or cable means extending between said upper and lower pulley; said rope or cable means passing over said sheave wheel means on said lifting arm at a location between said upper and lower pulleys; and means for moving said sheave wheel means with respect to said lifting arm in a horizontal plane with respect to the vertical central axis of the lifting support.

2. The lifting mechanism of claim 1, wherein said means for attaching comprises:

(a) mounting yoke means for mounting said lifting arm to the support at an intermediate portion thereof; and (b) means encircling the intermediate portion of the support for attaching said mounting yoke means to the support.

3. The lifting mechanism of claim 2, wherein said means encircling the intermediate portion of the support comprises:

(a) a belt for wrapping about the support; and (b) buckle means for fastening aid belt about the support.

4. The lifting mechanism of claim 2, wherein said mounting yoke means comprises:

a plurality of attaching members spaced from each other along the vertical axis of the support.

5. The lifting mechanism of claim 4, wherein said mounting yoke means comprises:

a yoke arm interconnecting said plurality of attaching members.

6. The lifting mechanism of claim 5, wherein said plurality of attaching members comprise:

(a) a first attaching member mounted with said lifting arm means; and (b) a second attaching member mounted at a spaced position on the pole from said first attaching member by said yoke arm.

7. The lifting mechanism of claim 6, further including:

a support strut connecting said second attaching member to said lifting arm.

8. The lifting mechanism of claim 1, wherein said means for transferring the load comprises:

a load transfer strap connected between said lifting arm means and the support.

9. The lifting mechanism of claim 1, wherein said means for transferring the load comprises:

a load transfer strap connected between said lifting arm means and the support and encircling the support.

10. The lifting mechanism of claim 1, wherein said means for moving comprises:

(a) a cylinder member mounted with the support by said means for attaching;

(b) a piston member mounted in said cylinder member; and (c) means for causing relative movement of said piston member in said cylinder member.

11. The lifting mechanism of claim 1, wherein said means for moving comprises:

means for moving said sheave wheel means with respect to said lifting arm inwardly and outwardly in a horizontal plane with respect to the vertical central axis of the support.

12. The lifting mechanism of claim 1, wherein said means for moving comprises:

a threaded member rotatably mounted in aid lifting arm and connected to said sheave wheel means; and means for incrementally rotating said threaded member to adjust the position of said sheave wheel means.

* * * * *